US006698075B1

(12) United States Patent
Wu

(10) Patent No.: US 6,698,075 B1
(45) Date of Patent: Mar. 2, 2004

(54) HOLDING DEVICE OF TIMING BELT WHEEL STRUCTURE

(76) Inventor: Pi-Liang Wu, P.O. Box 55-124, Taichung (TW)

( * ) Notice: Subject to any disclaimer, the term of this patent is extended or adjusted under 35 U.S.C. 154(b) by 0 days.

(21) Appl. No.: 10/403,301

(22) Filed: Apr. 1, 2003

(51) Int. Cl.[7] ..... B25B 27/14

(52) U.S. Cl. ..... 29/281.5; 29/281.6; 29/271

(58) Field of Search ..... 29/281.5, 281.6, 29/281.1, 271, 888.011, 402.03, 402.08, 426.1, 464, 239; 269/253, 203, 258, 262, 261, 268, 270, 909, 35, 37, 82; 188/2 R, 4 R, 74, 36

(56) References Cited

U.S. PATENT DOCUMENTS 5,755,029 A * 5/1998 Learned ..... 29/888.011
5,950,294 A * 9/1999 Gibbs ..... 29/281.5
6,058,585 A * 5/2000 Soleymani ..... 29/281.6
6,332,256 B1 * 12/2001 Dawson ..... 29/281.5

* cited by examiner

*Primary Examiner*—Robert C. Watson

(57) ABSTRACT

A holding device of a timing belt wheel structure includes two links, and two holding members. Thus, the relative position between the two holding members and the relative angle between the snap plates of the two holding members can be adjusted arbitrarily so as to fit the relative position of the two timing belt wheels, so that the holding device can be used to hold and position timing belt wheel structures of different sizes, types and specifications without having to prepare multiple holders of different sizes, types and specifications, thereby enhancing convenience in operation and maintenance of the timing belt wheel structure.

15 Claims, 6 Drawing Sheets

HOLDING DEVICE OF TIMING BELT WHEEL STRUCTURE

BACKGROUND OF THE INVENTION

1. Field of the Invention

The present invention relates to a holding device of a timing belt wheel structure, and more particularly to a holding device that can be used to hold and position timing belt wheel structures of different sizes, types and specifications without having to prepare holders of different sizes, types and specifications, thereby enhancing convenience in operation and maintenance of the timing belt wheel structure.

2. Description of the Related Art

A first conventional holder 1 of a timing belt wheel structure in accordance with the prior art shown in FIG. 1 has a top end provided with two protruded teeth 2, and a bottom end provided with two protruded teeth 2'. Thus, the holder 1 can be inserted between two opposite timing belt wheels 8 of the timing belt wheel structure, whereby the protruded teeth 2 and 2' can be inserted into and secured in the toothed grooves of the two opposite timing belt wheels 8, to prevent the two opposite timing belt wheels 8 from being rotated, thereby facilitating the user replacing the timing belt 9 of the timing belt wheel structure. However, the first conventional holder only has a fixed size and cannot be used to hold and position timing belt wheels of different sizes, types and specifications, so that the user has to prepare multiple holders of different sizes, types and specifications to fit the timing belt wheels of different sizes, types and specifications, thereby causing inconvenience in operation and maintenance.

A second conventional holder of a timing belt wheel structure in accordance with the prior art shown in FIGS. 2 and 3 comprises two arm plates 3, and a connecting member 4 mounted between the two arm plates 3. Each of the two arm plates 3 is pivoted with the connecting member 4 by a locking member 5. Each of the two arm plates 3 has a first end formed with an upright fixing snap 302 vertical to the arm plate 3, and a second end pivoted with a movable snap 304 by a securing member 6. The movable snap 304 is opposite to the fixing snap 302. The fixing snap 302 is laterally protruded with a snap tooth 3022, and each of the movable snap 304 is laterally protruded with a snap tooth 3042 that is opposite to the snap tooth 3022 of the fixing snap 302, so that the snap tooth 3022 of the fixing snap 302 can mate with the snap tooth 3042 of the movable snap 304 to be inserted into a timing belt wheel structure for holding and securing the timing belt wheel structure.

In operation, referring to FIG. 3, the second conventional holder can be used to hold and secure two timing belt wheels 8 of the timing belt wheel structure. First, each of the two locking members 5 and each of the two securing members 6 are loosened. Then, the second conventional holder can be inserted between the two timing belt wheels 8 of the timing belt wheel structure. The distance and the angle between the two arm plates 3 can be adjusted to fit the relative position of the two timing belt wheels 8, and each of the two movable snaps 304 may be driven, so as to adjust the distance between the movable snap 304 and the fixing snap 302, so that the snap tooth 3022 of the fixing snap 302 can mate with the snap tooth 3042 of the movable snap 304 to be inserted into the toothed groove of the outer periphery of the two timing belt wheels 8 of the timing belt wheel structure for holding and securing the two timing belt wheels 8 of the timing belt wheel structure. Then, each of the two locking members 5 and each of the two securing members 6 can be tightened, so as to secure and position each of the two arm plates 3 and each of the two movable snaps 304, so that the two timing belt wheels 8 of the timing belt wheel structure can be secured and positioned by the snap tooth 3022 of the fixing snap 302 and the snap tooth 3042 of the movable snap 304, thereby facilitating the user replacing the timing belt 9 of the timing belt wheel structure.

SUMMARY OF THE INVENTION

The primary objective of the present invention is to provide a holding device that can be used to hold and position timing belt wheel structures of different sizes, types and specifications without having to prepare multiple holders of different sizes, types and specifications, thereby greatly enhancing convenience in operation and maintenance of the timing belt wheel structure.

Another objective of the present invention is to provide a holding device of a timing belt wheel structure, wherein each of the snap plates has a simple configuration, so that the snap plates can be worked easily, thereby reducing costs of fabrication.

In accordance with the present invention, there is provided a holding device of a timing belt wheel structure, comprising two links, a first holding member secured on a first end of each of the two links, and a second holding member movably mounted on each of the two links so as to adjust the distance between the first holding member and the second holding member, wherein:

- each of the first holding member and the second holding member includes a first snap plate, a second snap plate, and a locking bolt;
- the first snap plate has a first end formed with a bent snap portion and a second end provided with a shaft tube;
- the second snap plate has a first end formed with a bent snap portion and a second end provided with a threaded tube juxtaposed to the shaft tube; and
- the locking bolt has a first end extended through the shaft tube and screwed into the threaded tube, so as to combine the first snap plate and the second snap plate, thereby forming the first holding member and the second holding member.

Further benefits and advantages of the present invention will become apparent after a careful reading of the detailed description with appropriate reference to the accompanying drawings.

DETAILED DESCRIPTION OF THE INVENTION

Figure 1:
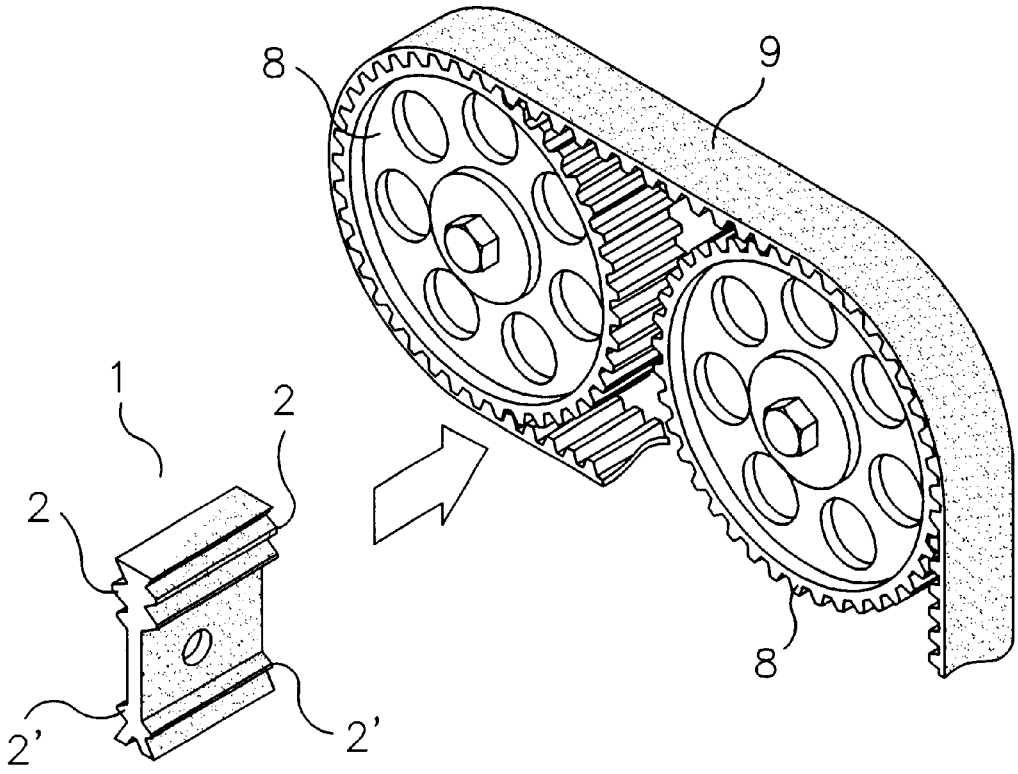
FIG. 1 PRIOR ART
FIG. 1 is a perspective view of a first conventional holder of a timing belt wheel structure in accordance with the prior art.
Figure 2:
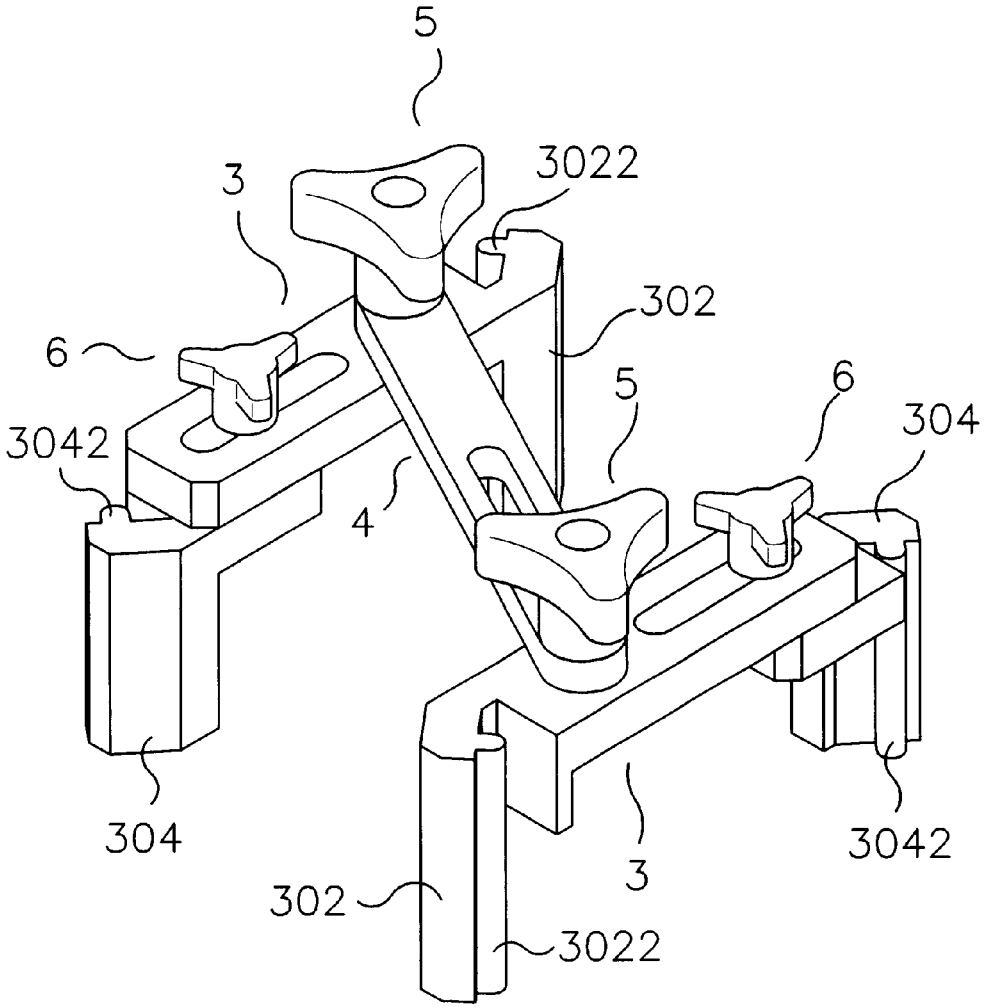
FIG. 2 PRIOR ART
FIG. 2 is a perspective view of a second conventional holder of a timing belt wheel structure in accordance with the prior art.
Figure 3:
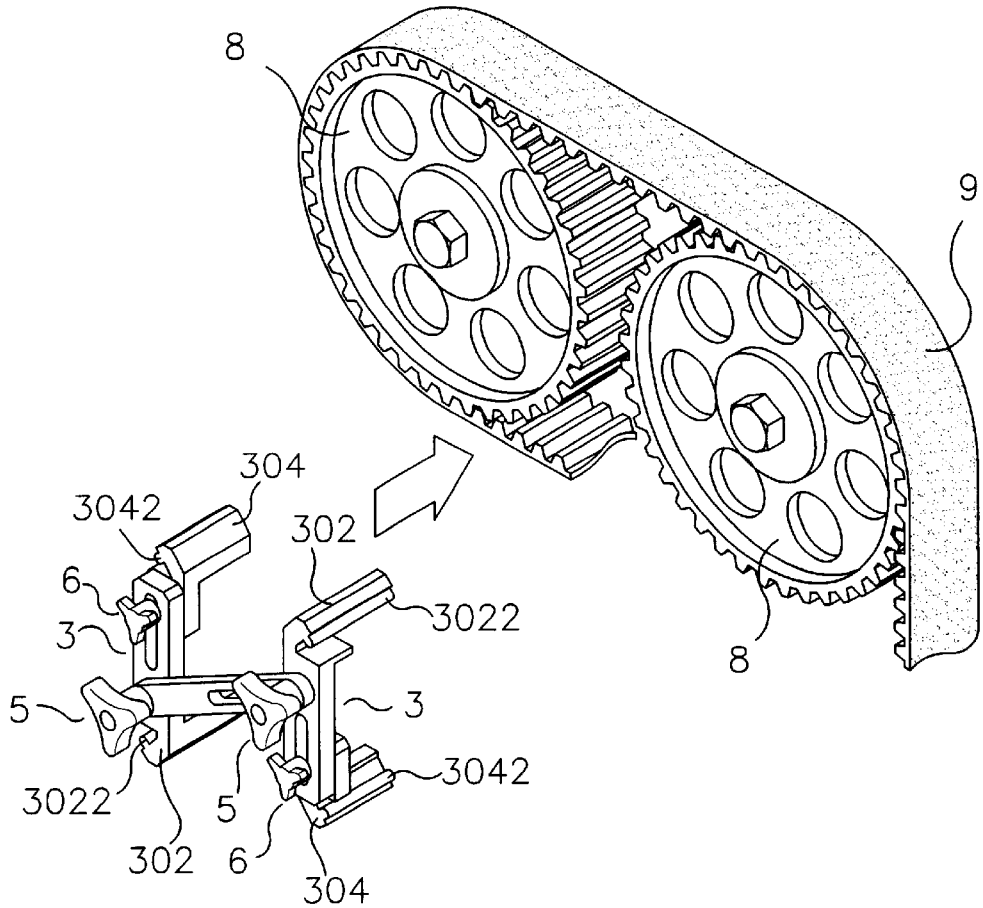
FIG. 3 PRIOR ART
FIG. 3 is a schematic operational view of the second conventional holder of a timing belt wheel structure as shown in FIG. 1 in use.
Figure 4:
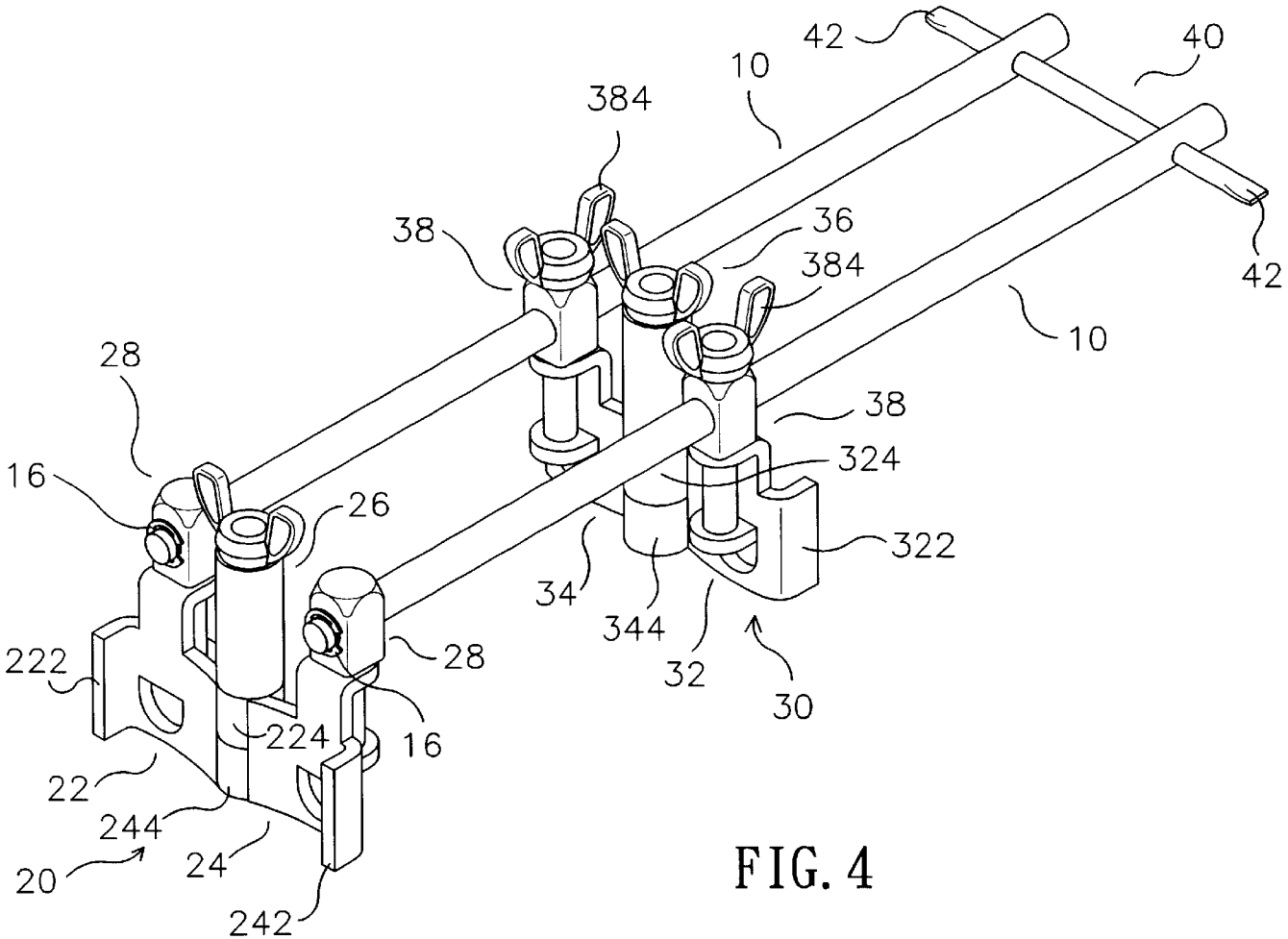
FIG. 4 is a perspective view of a holding device of a timing belt wheel structure in accordance with the preferred embodiment of the present invention.
Figure 5:
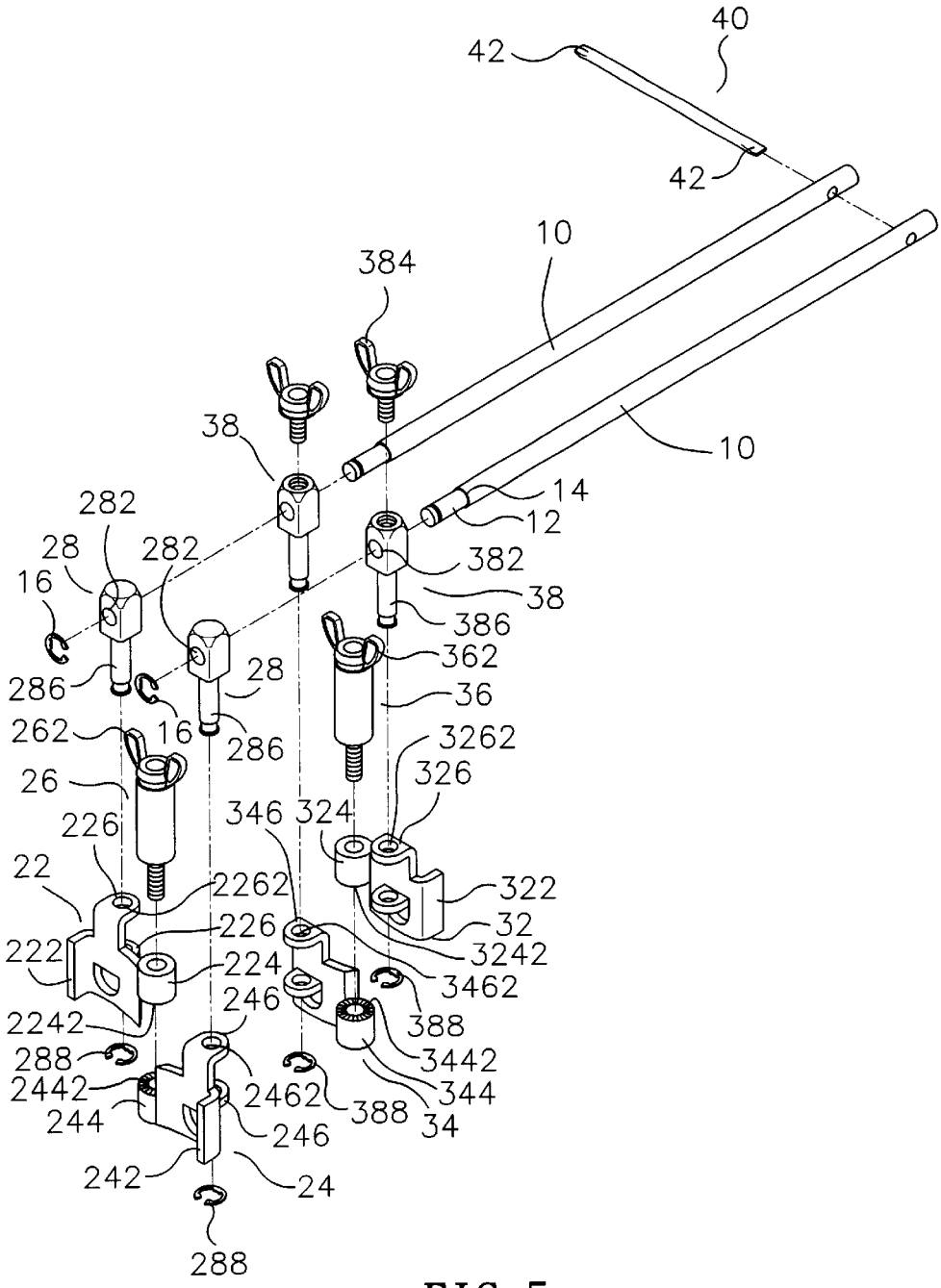
FIG. 5 is an exploded perspective view of the holding device of a timing belt wheel structure as shown in FIG. 4.

Referring to the drawings and initially to FIGS. 4 and 5, a holding device of a timing belt wheel structure in accordance with the preferred embodiment of the present invention comprises two links 10, a first holding member 20 secured on a first end of each of the two links 10, and a second holding member 30 movably mounted on each of the two links 10 so as to adjust the distance between the first holding member 20 and the second holding member 30.

Each of the first holding member 20 and the second holding member 30 includes a first snap plate 22 and 32, a second snap plate 24 and 34, and a locking bolt 26 and 36. The first snap plate 22 and 32 has a first end formed with a bent snap portion 222 and 322 and a second end provided with a shaft tube 224 and 324. The second snap plate 24 and 34 has a first end formed with a bent snap portion 242 and 342 and a second end provided with a threaded tube 244 and 344 juxtaposed to the shaft tube 224 and 324.

The locking bolt 26 and 36 has a first end extended through the shaft tube 224 and 324 and screwed into the threaded tube 244 and 344, so as to combine the first snap plate 22 and 32 and the second snap plate 24 and 34, thereby forming the first holding member 20 and the second holding member 30. The locking bolt 26 and 36 has a second end provided with a butterfly head 262 and 362.

In addition, the shaft tube 224 and 324 has an end face formed with a plurality teeth 2242 and 3242, and the threaded tube 244 and 344 has an end face formed with a plurality engaging teeth 2442 and 3442 meshing with the teeth 2242 and 3242. Preferably, the teeth 2242 and 3242 are arranged in a radiating manner, and the engaging teeth 2442 and 3442 are arranged in a radiating manner. In such a manner, the shaft tube 224 and 324 is locked on the threaded tube 244 and 344 rigidly and stably, thereby enhancing the combination strength of the first snap plate 22 and 32 and the second snap plate 24 and 34.

The first holding member 20 further includes two connecting members 28 each mounted between a respective one of the first snap plate 22 and the second snap plate 24 of the first holding member 20 and a respective one of the two links 10. Each of the two connecting members 28 is formed with a mounting hole 282. The first end of each of the two links 10 is formed with a reduced connecting shaft 12 extended through the mounting holes 282 of a respective one of the two connecting members 28 and snapped with a snap ring 16, thereby securing each of the two connecting members 28 on the respective link 10, and thereby positioning the first holding member 20 on the two links 10. The first end of each of the two links 10 is formed with a stop 14 located adjacent to the reduced connecting shaft 12 and rested on the respective connecting member 28, so that the connecting member 28 is clamped between the snap ring 16 and the stop 14.

In addition, each of the first snap plate 22 and the second snap plate 24 of the first holding member 20 is provided with two connecting ears 226 and 246 each formed with a pivot hole 2262 and 2462. Each of the two connecting members 28 is provided with a pivot rod 286 extended through the pivot hole 2262 and 2462 of a respective one of the first snap plate 22 and the second snap plate 24 of the first holding member 20 and snapped with a snap ring 288, so that each of the first snap plate 22 and the second snap plate 24 of the first holding member 20 is pivotally mounted on the respective connecting member 28.

The second holding member 30 further includes two sliding members 38 each mounted between a respective one of the first snap plate 32 and the second snap plate 34 of the second holding member 30 and a respective one of the two links 10. Each of the two sliding members 38 is formed with a mounting hole 382 for passage of the respective link 10, so that each of the two sliding members 38 is slidably mounted on the respective link 10. Each of the two sliding members 38 is screwed with a bolt 384 which has a distal end rested on the respective link 10, thereby positioning each of the two sliding members 38 on the respective link 10.

In addition, each of the first snap plate 32 and the second snap plate 34 of the second holding member 30 is provided with two connecting ears 326 and 346 each formed with a pivot hole 3262 and 3462. Each of the two sliding members 38 is provided with a pivot rod 386 extended through the pivot hole 3262 and 3462 of a respective one of the first snap plate 32 and the second snap plate 34 of the second holding member 30 and snapped with a snap ring 388, so that each of the first snap plate 32 and the second snap plate 34 of the second holding member 30 is pivotally mounted on the respective sliding member 38.

The holding device further comprises a catch member 40 mounted on a second end of each of the two links 10 for combining the two links 10 so as to retain the second holding member 30, thereby preventing the second holding member 30 from detaching from the two links 10. Preferably, the catch member 40 is extended through the second end of each of the two links 10 and has two ends each formed with a limit portion 42 to prevent the catch member 40 from detaching from each of the two links 10.

Figure 6:
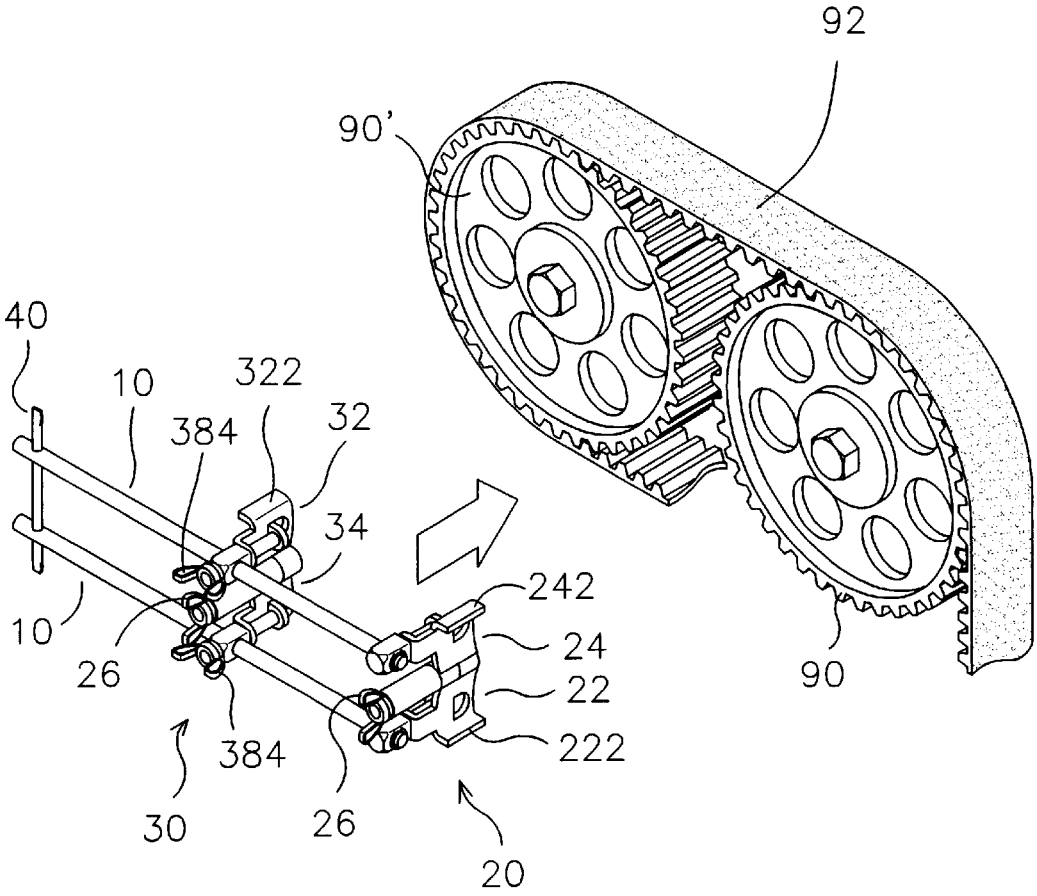
FIG. 6 is a schematic operational view of the holding device of a timing belt wheel structure as shown in FIG. 4 in use.

In operation, referring to FIGS. 4–6, the holding device can be used to hold and secure two timing belt wheels 90 and 90' of the timing belt wheel structure.

First of all, the locking bolts 26 and 36 and the bolt 384 of each of the two sliding members 38 are unscrewed, so that the first snap plate 22 and the second snap plate 24 of the first holding member 20 and the first snap plate 32 and the second snap plate 34 of the second holding member 30 can be pivoted freely, while the second holding member 30 can be displaced on the two links 10, so as to adjust the distance between the first holding member 20 and the second holding member 30.

Then, the first holding member 20 and the second holding member 30 of the holding device can be inserted between the two timing belt wheels 90 and 90' of the timing belt wheel structure, with the snap portion 222 and 242 of the first snap plate 22 and the second snap plate 24 of the first holding member 20 being inserted into the toothed groove of the outer periphery of the timing belt wheel 90 of the timing belt wheel structure. Then, the locking bolt 26 is screwed and locked, so that the first snap plate 22 and the second snap plate 24 of the first holding member 20 are combined and fixed closely without movement. Then, the second holding member 30 can be displaced on the two links 10, so that the snap portion 322 and 342 of the first snap plate 32 and the second snap plate 34 of the second holding member 30 are inserted into the toothed groove of the outer periphery of the timing belt wheel 90' of the timing belt wheel structure. Then, the locking bolt 36 is screwed and locked, so that the first snap plate 32 and the second snap plate 34 of the second holding member 30 are combined and fixed closely without movement. Finally, the bolt 384 of each of the two sliding members 38 are screwed and locked, so that the second holding member 30 is fixed on the two links 10.

In such a manner, the two timing belt wheels 90 and 90' of the timing belt wheel structure are fixed by the holding device, thereby facilitating the user replacing the timing belt 92 of the timing belt wheel structure.

Accordingly, in accordance with the holding device of the present invention, the relative position between the first holding member 20 and the second holding member 30 and the relative angle between the first snap plate 22 and 32 and the second snap plate 24 and 34 can be adjusted arbitrarily so as to fit the relative position of the two timing belt wheels 90 and 90', so that the holding device of the present invention may be used to hold and position timing belt wheel structures of different sizes, types and specifications without having to prepare multiple holders of different sizes, types and specifications, thereby enhancing convenience in operation and maintenance of the timing belt wheel structure.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A holding device of a timing belt wheel structure, comprising two links, a first holding member secured on a first end of each of the two links, and a second holding member movably mounted on each of the two links so as to adjust the distance between the first holding member and the second holding member, wherein:

each of the first holding member and the second holding member includes a first snap plate, a second snap plate, and a locking bolt;

the first snap plate has a first end formed with a bent snap portion and a second end provided with a shaft tube;

the second snap plate has a first end formed with a bent snap portion and a second end provided with a threaded tube juxtaposed to the shaft tube; and the locking bolt has a first end extended through the shaft tube and screwed into the threaded tube, so as to combine the first snap plate and the second snap plate, thereby forming the first holding member and the second holding member.

2. The holding device of a timing belt wheel structure in accordance with claim 1, wherein the shaft tube has an end face formed with a plurality teeth, and the threaded tube has an end face formed with a plurality engaging teeth meshing with the teeth.

3. The holding device of a timing belt wheel structure in accordance with claim 2, wherein the teeth are arranged in a radiating manner.

4. The holding device of a timing belt wheel structure in accordance with claim 2, wherein the engaging teeth are arranged in a radiating manner.

5. The holding device of a timing belt wheel structure in accordance with claim 1, wherein the locking bolt has a second end provided with a butterfly head.

6. The holding device of a timing belt wheel structure in accordance with claim 1, wherein the first holding member includes two connecting members each mounted between a respective one of the first snap plate and the second snap plate of the first holding member and a respective one of the two links.

7. The holding device of a timing belt wheel structure in accordance with claim 6, wherein each of the two connecting members is formed with a mounting hole, and the first end of each of the two links is formed with a reduced connecting shaft extended through the mounting holes of a respective one of the two connecting members and snapped with a snap ring, thereby securing each of the two connecting members on the respective link, and thereby positioning the first holding member on the two links.

8. The holding device of a timing belt wheel structure in accordance with claim 7, wherein the first end of each of the two links is formed with a stop located adjacent to the reduced connecting shaft and rested on the respective connecting member, so that the connecting member is clamped between the snap ring and the stop.

9. The holding device of a timing belt wheel structure in accordance with claim 6, wherein each of the first snap plate and the second snap plate of the first holding member is provided with two connecting ears each formed with a pivot hole, and each of the two connecting members is provided with a pivot rod extended through the pivot hole of a respective one of the first snap plate and the second snap plate of the first holding member and snapped with a snap ring, so that each of the first snap plate and the second snap plate of the first holding member is pivotally mounted on the respective connecting member.

10. The holding device of a timing belt wheel structure in accordance with claim 1, wherein the second holding member includes two sliding members each mounted between a respective one of the first snap plate and the second snap plate of the second holding member and a respective one of the two links.

11. The holding device of a timing belt wheel structure in accordance with claim 10, wherein each of the two sliding members is formed with a mounting hole for passage of the respective link, so that each of the two sliding members is slidably mounted on the respective link.

12. The holding device of a timing belt wheel structure in accordance with claim 10, wherein each of the two sliding members is screwed with a bolt which has a distal end rested on the respective link, thereby positioning each of the two sliding members on the respective link.

13. The holding device of a timing belt wheel structure in accordance with claim 10, wherein each of the first snap plate and the second snap plate of the second holding member is provided with two connecting ears each formed with a pivot hole, and each of the two sliding members is provided with a pivot rod extended through the pivot hole of a respective one of the first snap plate and the second snap plate of the second holding member and snapped with a snap ring, so that each of the first snap plate and the second snap plate of the second holding member is pivotally mounted on the respective sliding member.

14. The holding device of a timing belt wheel structure in accordance with claim 1, further comprising a catch member mounted on a second end of each of the two links for combining the two links so as to retain the second holding member, thereby preventing the second holding member from detaching from the two links.

15. The holding device of a timing belt wheel structure in accordance with claim 14, wherein the catch member is extended through the second end of each of the two links and has two ends each formed with a limit portion to prevent the catch member from detaching from each of the two links.

* * * * *